United States Patent [19]

Linehan et al.

[11] Patent Number: 4,506,622

[45] Date of Patent: Mar. 26, 1985

[54] HAWSER LINE FLOTATION

[75] Inventors: Joseph J. Linehan, Arlington; Phillip S. Amato, Saugus, both of Mass.

[73] Assignee: Samson Ocean Systems, Inc., Waltham, Mass.

[21] Appl. No.: 554,290

[22] Filed: Nov. 22, 1983

[51] Int. Cl.[3] ..... B63B 21/52

[52] U.S. Cl. ..... 114/230; 441/133

[58] Field of Search ..... 114/230, 243, 251; 441/133, 80; 405/63, 71; 174/101.5; 367/14, 15, 141; 4/505

[56] References Cited

U.S. PATENT DOCUMENTS

| | | | |
|---|---|---|---|
| 2,419,053 | 4/1947 | Bennett | 174/101.5 |
| 3,597,779 | 8/1969 | Morgan | 174/101.5 |
| 4,042,990 | 8/1977 | Donaldson, Jr. | 114/230 |
| 4,188,679 | 2/1980 | Hollaender et al. | 441/133 |

*Primary Examiner*—Trygve M. Blix
*Assistant Examiner*—Edwin L. Swinehart
*Attorney, Agent, or Firm*—W. R. Hulbert

[57] ABSTRACT

A float element for hawser lines, such as used on a single point mooring. The element has a fixed, finite length and is adapted for attachment to the hawser line in a manner to permit elongation of the line under load with the float element in place. The float element has a male end portion and an opposed female end portion, the element being adapted to be attached with the male end portion of a first element adjacent the female end portion of a second element. The male end portion of the first element installed about the line has an outside diameter significantly less than the inside diameter of female end portion of second element. For substantial loads applied to the hawser line, the female end portion of one element is adapted to enclose the male end portion of the adjacent element, whereby the hawser line is continuously enclosed by adjacent elements substantially over their combined length. A flotation system for a hawser line comprising a multiplicity of float elements is also disclosed.

5 Claims, 12 Drawing Figures

HAWSER LINE FLOTATION

BACKGROUND OF THE INVENTION

The invention relates to hawser line flotation.

Hawser flotation is attached about hawser line used, e.g., on single point moorings (SPM) for off-shore oil ports. Hawser lines, which typically have circumferences of 5 to 30 inches and breaking strengths of over 20,000 kgs. (for a 5-inch circumference line) to over 600,000 kgs. (for a 21-inch circumference line), are provided as hawser units, typically weighing 2,200 kgs. or more per 100 feet for the larger sizes, with hawser floats and terminations in place. The hawser units are installed at the single point mooring and are left in place for the life of the line, typically about 6 to 8 months.

The hawser flotation keeps the line afloat when not in use and provides protection against chafing and abrasion where the line is covered by the floats. The line, of course, stretches when in use due to the extreme weight of the oil tanker, and contracts when the weight is removed. Thus the flotation elements, which have fixed length, are spaced, leaving sections of line therebetween exposed to the elements and to wear. The flotation elements, which are initially installed at the rope works, also must be spaced to permit the hawser to be bent for crating and shipping.

The flotation elements are also subject to damage and loss during use. Periodic hawser inspections are conducted on location, and it is desirable that missing or damaged elements be replaced. However, the process required for lacing the new elements about the hawser is typically time consuming and difficult, and under normal working conditions has not been done except where absolutely required. Thus portions of the hawser line have been left exposed to chafing, wear, and other damage, with a resulting shortening of the useful life of the hawser.

It is the objective of this invention to provide hawser flotation which may be positioned about the hawser in close proximity to adjacent floats to minimize the section of rope exposed to wear.

It is a further objective to provide hawser flotation which is easily installed on the hawser line, either at the rope works or in the field, and also to provide a simple method of installing the new hawser float elements.

SUMMARY OF THE INVENTION

The invention relates to a flotation element for hawser lines such as used on a single point mooring, the flotation element being adapted for attachment about a hawser line and having a fixed, finite length and further being adapted for attachment to the hawser line in a manner to permit elongation of the hawser line under load with the flotation element in place.

According to the invention, the flotation element has a male end portion and an opposed female end portion, the element being adapted to be attached about the hawser line with the male end portion of a first element adjacent the female end portion of a second element, the male end portion of the first element installed about the line having an outside diameter significantly less than the inside diameter of female end portion of the second element, whereby, for substantial loads applied to the hawser line, the male end portion of the first element is adapted to remain within the female end portion of the second element and the hawser line is continously enclosed by adjacent elements substantially over the combined length thereof.

In preferred embodiments, in unloaded condition, the male end portion of the first flotation element underlying the female end portion of the second flotation element constitutes a significant percentage of the length of the first flotation element, preferably, in unloaded condition, the male end portion of the first element underlying the female end portion of the second element constitutes about twenty percent of the length of the first element; the flotation element comprises a flexible casing adapted for attachment about the hawser line, adjacent to, opposed edges the casing defining attachment means for fixable interconnection of the edges and, secured therewithin, a plurality of float components having specific gravity less than that of water, preferably the float components are closed cell polymer foam; the float components include a broad, circumferential section within the casing at the female end portion of the flotation element, the circumferential section adapted, within the casing, to form a collar encircling the hawser line, the circumference of the relatively stiff collar significantly exceeding the circumference of the encircled hawser line, thereby forming an annular aperture between the casing and the line for insertion of the male end portion of an adjacent element, and a multiplicity of relatively rigid elongated sections arrayed coaxially within the casing, generally parallel to the opposed edges, and the elongated sections are adapted for attachment, within the casing, about the hawser line, coaxially therewith, the first ends of the elongated sections lying adjacent the inwardly directed edge of the circumferential section, the opposed ends of the elongated sections lying spaced from the opposite end of the casing, the end of the casing extending axially beyond the elongated sections being adapted for attachment closely about the hawser line; the attachment means comprising a multiplicity of eyelet apertures defined in spaced arrangement adjacent the opposed edges of casing, the eyelets, configured and arranged for overlaping alignment along the axis of the hawser line, with the casing in enclosing engagement thereabout, to receive a lacing drawn progressively therethrough.

In another aspect, the invention relates to a flotation system for a hawser line such as used on single point moorings, comprising a multiplicity of float elements adapted for attachment about a hawser line arrayed in generally end-to-end relationship, the individual flotation elements having a fixed finite length and being further adapted for attachment to the hawser line in a manner to permit elongation of the hawser line under load with the flotation elements in place.

According to this aspect of the invention, the flotation element has a male end portion and an opposed female end portion, the element being adapted to be attached about the hawser line with the male end portion of a first element adjacent the female end portion of a second element, the male end portion of the first element installed about the line having an outside diameter significantly less than the inside diameter of the female end portion of the second element, whereby, for substantial loads applied to the hawser line, the male end portion of the first element is adapted to remain within the female end portion of the second element and the hawser line is continously enclosed by adjacent elements substantially over their combined length.

DESCRIPTION OF THE PREFERRED EMBODIMENT

We first briefly describe the drawings.

DRAWINGS

FIG. 1 is a perspective view of an oil tanker moored to a single point mooring (SPM) by a hawser line with hawser flotation according to the invention, while

Figure 2:
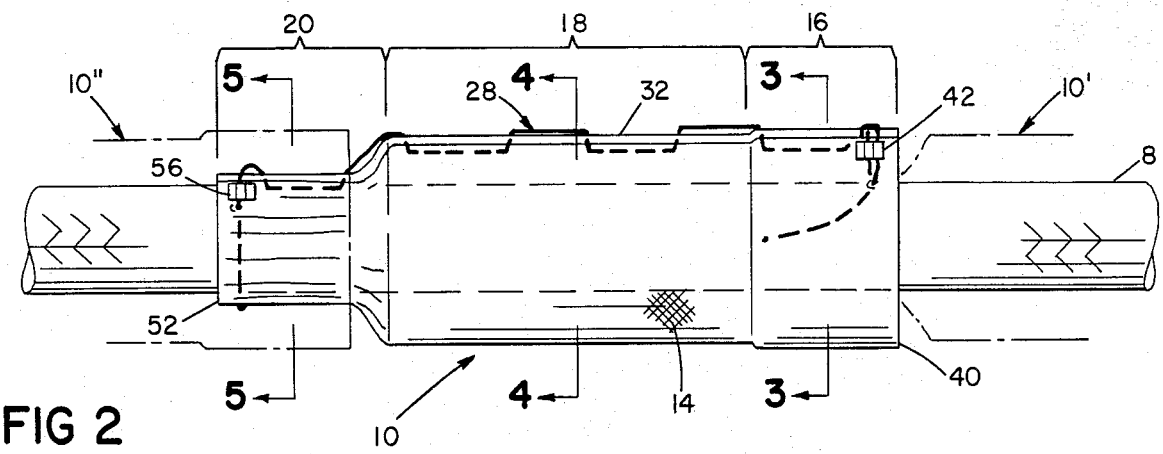
FIG. 2 is a side view of a hawser line with a first hawser flotation element according to the invention, and second and third adjacent flotation elements shown in phantom line.
Figure 5:
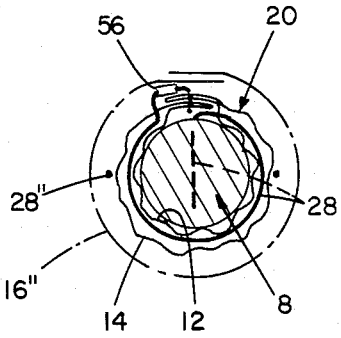
Figure 4:
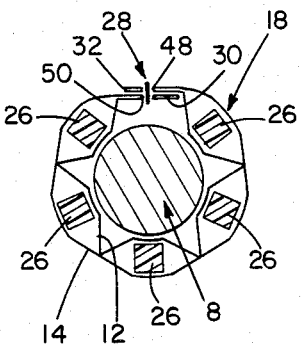
Figure 3:
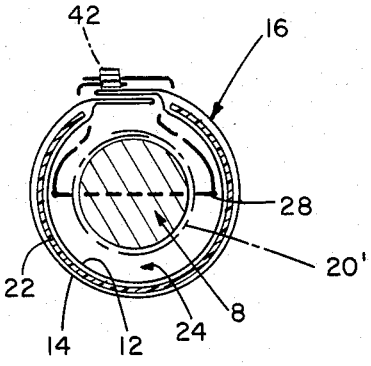
Figure 6:
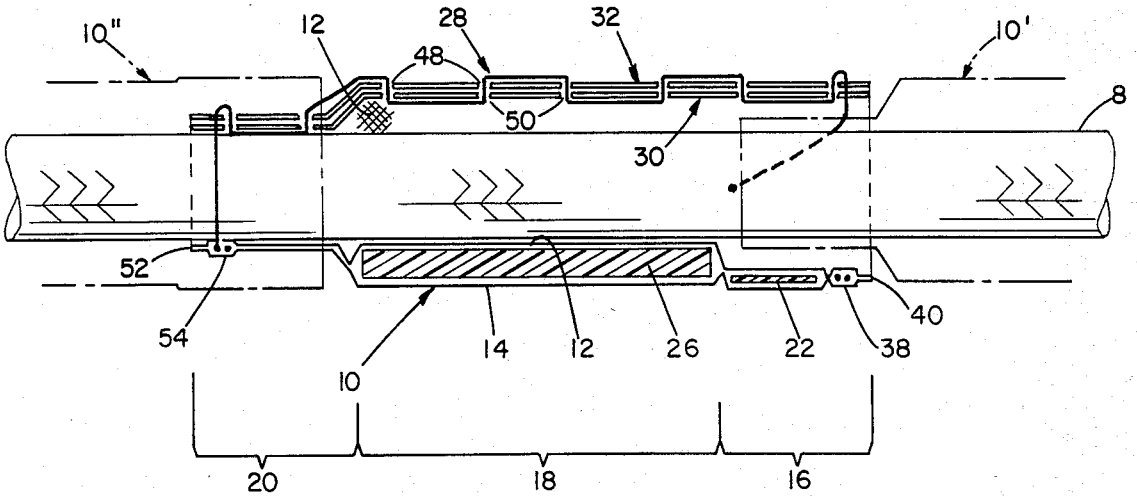

FIGS. 3, 4 and 5 are end section views taken at the lines 3—3, 4—4 and 5—5, respectively, of FIG. 2; while FIG. 6 is a side section view of the hawser float of FIG. 2; and FIG. 7, 7*a*, 7*b*, 7*c* and 7*d* are perspective views showing the attachment of a hawser flotation element according to the invention about a hawser line, e.g. in the field.

STRUCTURE

Figure 1:
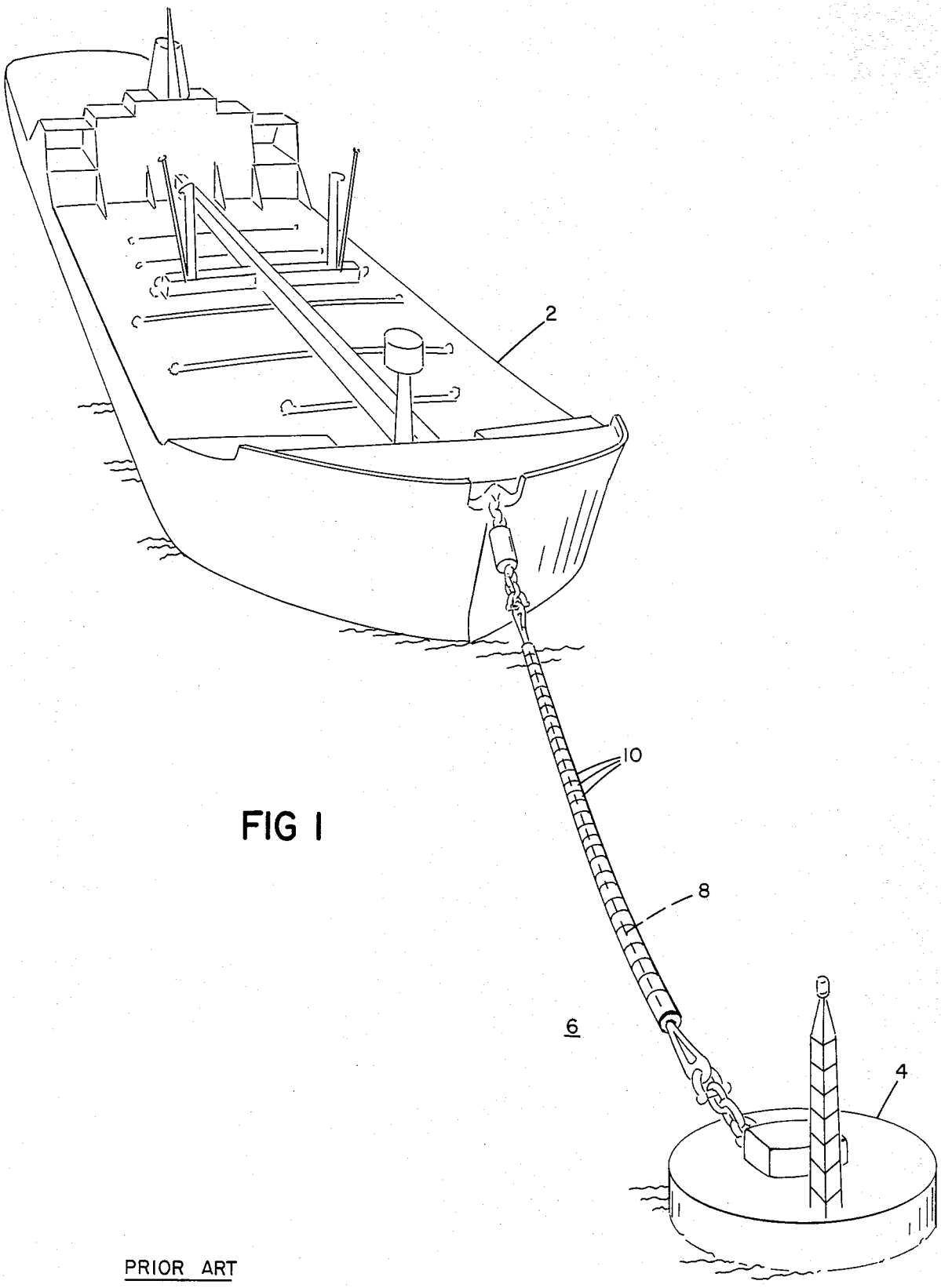
FIG 1 PRIOR ART

Referring now to FIG. 1, an oil tanker 2 is shown moored to a single point mooring (SPM) 4, e.g. at an off-shore drilling site 6, by means of hawser line 8. Attached about the hawser line, typically over substantially the entire length, are hawser flotation elements 10, which serve to keep the hawser line afloat when not in use, and which also protect the line from wear due to exposure and abrasion, to increase its useful life. As shown in the figure, and as will be discussed in more detail below, the float elements 10 are installed in a manner such that adjacent floats overlap, even during the stretching of the hawser line 8 when a loaded tanker 2 is moored during high seas, to completely enclose and protect the hawser line at all times.

Figure 1A:
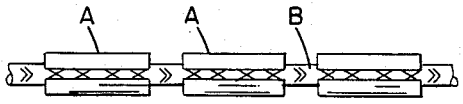
FIG. 1*a* is a plan view of a section of typical hawser line with prior art flotation.

The typical prior art hawser float system is shown in FIG. 1*a*, with gaps of exposed line B, typically about 8 or 9 inches in length, between the well separated float elements A.

Referring now to FIG. 2, and also to FIGS. 3 through 6, the hawser float element of the invention is shown in more detail.

In FIG. 2, float 10 is shown attached about hawser line 8. Adjacent floats 10' and 10'' are shown in phantom line for illustration of the protective interrelationship provided by the system described.

Float 10 is comprised of inner and outer layers 12, 14 of nylon ballistic canvas, typically orange or some other bright color, stitched around the periphery. The overall length of float 10 is about 48 inches. The width varies with the circumference of the line that it is desired to protect, the width of the float exceeding the line circumference by at least an amount sufficient to allow overlap for lacing as will be described below. Each float element is divided over its length into female end portion 16, body portion 18, which provides most of the bouyancy, and male portion 20. The portions are shown in crosssection in FIGS. 3, 4 and 5, respectively.

The female end portion 16 contains, between layers of canvas 12, 14, a semirigid collar 22, typically ½ inch thick and 8 inches wide, of closed cell polyethylene foam. When float 10 is attached around line 8, collar 22 is formed with a circumference significantly greater than the diameter of line 8 and the male end portion 20' of the adjacent float 10'. The collar 22 is relatively stiff to maintain the gap 24 allowing the adjacent float elements 10, 10' to move axially, e.g. under loading or wave movement.

The body portion 18 of float 10 contains, between layers 12, 14 of canvas, separate flotation elements 26 arrayed in parallel relationship across the width of the float. In a typical float 10, five flotation elements are provided, each about 2 to 2 ½ inches square and 30 inches in length, of closed cell polyethylene foam. When float 10 is installed about the line 8, float elements 26 are disposed about the circumference of the line, coaxial therewith and approximately equally spaced, to provide both bouyancy and protection for the line 8.

The male portion 20 of float 10 comprises the two layers 12, 14 of canvas extending axially beyond the ends of the flotation elements 26. The male end portion does not contain any flotation and is gathered closely about the circumference of line 8 to minimize the combined diameter to allow the female end portion 16'' of adjacent float 10'' to move axially without restriction.

Float 10 is secured about line 8 by means of revetment line 28, shown most clearly in FIG. 6. Line 28, typically 0.292 inch diameter DURAVET TM line, which is flexible yet stiff enough to be forced through hawser line 8 without tools, is laced through holes provided about the ends and overlapped side edges of the float element 10 and through the body of the hawser line 8 to secure the float element to the line.

Figure 7:
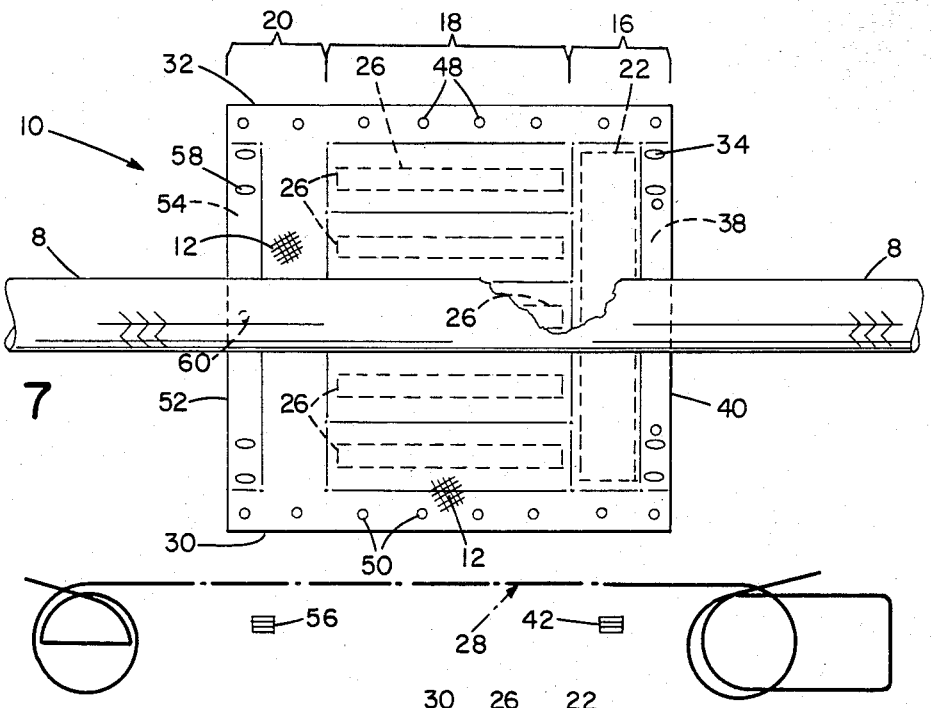
Figure 7A:
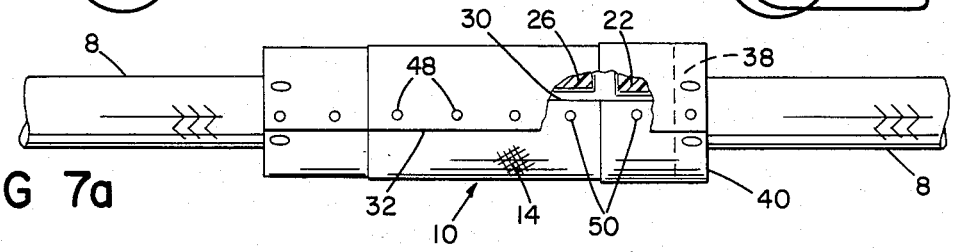
Figure 7B:
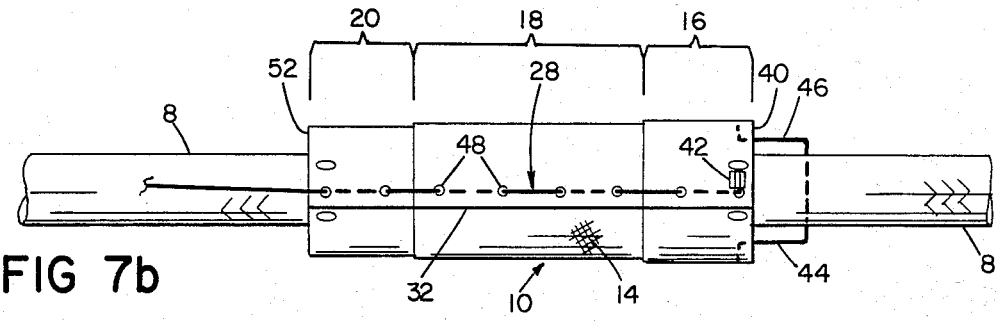
Figure 7C:
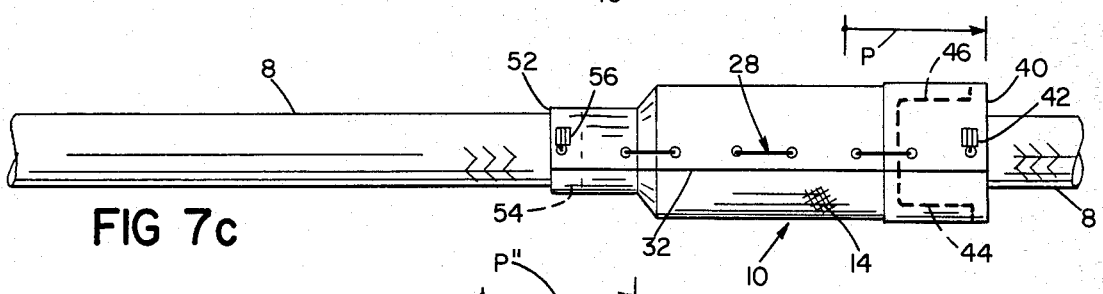
Figure 7D:
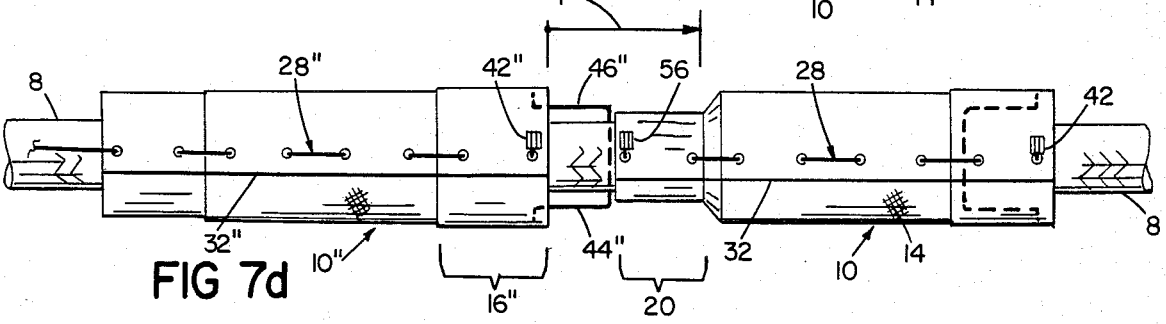

The procedure for attaching the float element 10 to hawser line 8 to provide protection over the length of the line is shown in FIGS. 7 through 7*d*.

In FIG. 7, float 10 is shown spread beneath hawser line 8 with accompanying revetment line 28, and clamps 42, 56. Referring now to FIGS. 7*a* through 7*d* in succession, float 10 is wrapped around hawser 8. Starting at female end 16, side edges 30, 32 are overlapped, and revetment line 28 is inserted through eyelet 34 and through both layers 12, 14 of the canvas at the overlap. Line 28 is pulled through until a 3 to 4 foot long end remains.

The remaining line 28 is pushed through sleeve 38 at the end edge 40 around the circumference of female end portion 16. The end of line 28 is fed through ferrule, or clamp, 42 and circumferentially through sleeve 38 a second time. Line 28 is then fed through hawser line 8 leaving approximately 10 inches of line 44, 46 on each side of hawser line 8 which will allow for stretch and expansion when the hawser line is under tension. The line is then secured through ferrule 42 and the ferrule is crimped. The free end of revetment line 28 is easily fed substantially linearly through eyelets 48, 50 along the side edges 30, 32 of float element 10 and pulled tight. Float element 10 is pulled axially (indicated by arrow P in FIG. 7*c*) along the hawser line to cover and tighten the slack 44, 46 left in the revetment line.

At the male end edge 52, revetment line 28 is inserted into sleeve 54 around the circumference and through ferrule 56 as previously described for the female end portion. Line 28 is passed through sleeve 54 a second time and pulled tight to form the male end 20 snug around hawser line 8. The remaining end of line 28 is pushed through eyelet 58, through the body of the hawser line, through eyelet 60 on the opposite side, and finally pulled tight again. The line is inserted into sleeve 54, pulled tight and ferrule 56 is crimped onto the line.

The procedure is repeated with a next adjacent float 10'', with the revetment line 28'' at the female end portion 16″ being passed through hawser line 8 closely adjacent to the male end portion 20 of the prior float 10 snugged about hawser line 8. When float 10″ is moved in direction P″ to take up the slack 44″, 46″, female end portion 16″ will cover and enclose male end portion 20 of float 10, typically to about 20 percent of the overall length of the float, to completely protect the underlying hawser line 8.

OPERATION

Hawser lines of the type shown in FIG. 1 are initially prepared in a factory. A line of prescribed length is manufactured, equipped with the desired terminations, and outfitted over the length with hawser float elements 10. The entire unit is then crated and placed aboard ship for installation at an offshore single point mooring. (This operating procedure requires that the line and floats have enough flexibility to permit coiling in a crate. In prior art systems, the floats were spaced to allow the line to bend. In the present system, the male and female end portions are sufficiently flexible to allow this to occur.)

The hawser line, equipped with flotation, is installed at the mooring, and is left in place during its entire useful life. Typically for hawser lines equipped with prior known float elements which left gaps (B, FIG. 1*a*), a $40,000 line had a useful life of about 6 to 8 months.

During the period when the line 8 is not in use, it floats loose on the ocean, connected, of course, by one end to the mooring point. As each tanker comes to the mooring, the free end of the hawser line is picked up and secured.

During the term of use, the hawser line and attached float elements are inspected periodically for wear and damage. Prior known float elements were typically not replaced due to the difficulty of performing the intricate cross-lacing required to secure those float elements, as shown in FIG. 1*a*, especially in the rough seas, and because, in any case, a major portion of the line was left exposed even with a full complement of float elements in place.

The flotation system provided according to the invention does not leave the hawser line exposed to the weather or to wear; and the improved system of attachment will permit replacement of lost or damaged float elements in the field, with resulting increase in useful life of the line.

We claim:

1. In a float element for a hawser line, such as used on a single point mooring, said float element being adapted for attachment about a hawser line, said element having a fixed, finite length and further being adapted for attachment to said hawser line in a manner to permit elongation of said hawser line under load with said flotation element in place, the improvement wherein, said float element has a male end portion and an opposed female end portion, said element being adapted to be attached about said hawser line with the male end portion of a first said element adjacent the female end portion of a second said element, the male end portion of said first element installed about said line having an outside diameter significantly less than the inside diameter of the female end portion of said second element, said float element comprising a flexible casing adapted for attchment about said hawser line, adjacent to opposed edges, said casing defining attachment means for fixable interconnection of said edges for attachment of said casing about said hawser line, and secured within said casing, a plurality of float components having specific gravity less than that of water, said float components comprising a broad, circumferential section within said casing at the female end portion of said float element, said circumferential section adapted, within said casing, to form a relatively stiff collar encircling said hawser line, the circumference of said collar significantly exceeding the circumference of the encircled hawser line, thereby forming an annular aperture between the casing and the line for insertion of the male end portion of an adjacent float element, and a multiplicity of relatively rigid elongated sections arrayed coaxially within said casing, generally parallel to said opposed edges, said elongated sections being adapted for attachment, within said casing, about said hawser line, coaxially therewith, the first ends of said elongated sections lying adjacent the inwardly directed edge of said circumferential section, the opposed ends of said elongated sections lying spaced from the opposite end of said casing, the end of said casing extending axially beyond said elongated sections being adapted for attachment closely about said hawser line, whereby, under substantial load applied to said hawser line, the female end portion of said second element is adapted to enclose the male end portion of said first element and said hawser line is continuously enclosed by said adjacent elements substantially over their combined length.

2. The float element of claim 1 wherein, in unloaded condition, the male end portion of said second float element enclosed by the female end portion of said first float element constitutes a significant percentage of the length of said first float element.

3. The float element of claim 2 wherein, in unloading condition, the male end portion of said second element enclosed by female end portion of said first element constitutes about twenty percent of the length of said second element.

4. The float element of claim 1 having float components of closed cell polymer foam.

5. The float element of claim 1 wherein said attachment means comprises a multiplicity of eyelet apertures defined in spaced arrangement adjacent the opposed edges of casing, said eyelets being configured and arranged for overlapping, substanially linear alignment along the axis of said hawser line, with said casing in enclosing engagement thereabout, to receive a lacing therethrough.

* * * * *